US010276984B2

(12) United States Patent
Trout et al.

(10) Patent No.: US 10,276,984 B2
(45) Date of Patent: Apr. 30, 2019

(54) CONNECTOR ASSEMBLY HAVING A PIN ORGANIZER

(71) Applicant: TE CONNECTIVITY CORPORATION, Berwyn, PA (US)

(72) Inventors: David Allison Trout, Lancaster, PA (US); Justin Dennis Pickel, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 95 days.

(21) Appl. No.: 15/648,499

(22) Filed: Jul. 13, 2017

(65) Prior Publication Data

US 2019/0020155 A1 Jan. 17, 2019

(51) Int. Cl.

| | |
|---|---|
| ***H01R 13/648*** | (2006.01) |
| ***H01R 13/6587*** | (2011.01) |
| ***H01R 24/78*** | (2011.01) |
| *H01R 107/00* | (2006.01) |

(52) U.S. Cl.

CPC ..... *H01R 13/6587* (2013.01); *H01R 24/78* (2013.01); *H01R 2107/00* (2013.01)

(58) Field of Classification Search

CPC ..... H01R 23/688; H01R 13/7197; H01R 23/6873; H01R 13/658

USPC ..... 439/607.1, 607.11, 607.12, 607.13

See application file for complete search history.

(56) References Cited

U.S. PATENT DOCUMENTS

| | | | | |
|---|---|---|---|---|
| 5,213,521 | A * | 5/1993 | Arisaka | H01R 13/6585 439/607.12 |
| 6,540,558 | B1 * | 4/2003 | Paagman | H01R 23/688 439/607.11 |
| 7,371,117 | B2 | 5/2008 | Gallus | |
| 7,503,773 | B2 | 3/2009 | Tokunaga | |
| 7,985,079 | B1 | 7/2011 | Wilson et al. | |
| 8,187,035 | B2 * | 5/2012 | Davis | H01R 12/724 439/607.02 |
| 8,535,065 | B2 | 9/2013 | Costello et al. | |
| 9,531,133 | B1 * | 12/2016 | Horning | H01R 13/6477 |
| 9,666,961 | B2 * | 5/2017 | Horning | H01R 12/7076 |
| 2002/0111068 | A1 * | 8/2002 | Cohen | H01R 13/514 439/607.11 |
| 2002/0192994 | A1 * | 12/2002 | Turner | H01R 13/193 439/342 |
| 2013/0081664 | A1 * | 4/2013 | Woods | H01L 35/32 136/204 |

(Continued)

*Primary Examiner* — Abdullah A Riyami
*Assistant Examiner* — Thang H Nguyen

(57) ABSTRACT

A connector assembly includes a shield structure and a contact module having signal contacts with signal pins and ground pins forming part of the shield structure providing electrical shielding for the signal pins. A pin organizer is coupled to the contact module and includes a conductive frame and a dielectric frame having plugs. The conductive frame is electrically connected to the shield structure and has ground pin holes receiving corresponding ground pins and windows receiving corresponding plugs. The plugs have signal pin holes receiving corresponding signal pins. The plugs electrically isolate the signal pins from the conductive frame. The pin organizer substantially fills a space between the bottoms of the contact modules and the circuit board to provide electrical shielding for the signal pins between the bottoms of the contact modules and the circuit board.

20 Claims, 9 Drawing Sheets

(56) References Cited

U.S. PATENT DOCUMENTS

| | | | | |
|---|---|---|---|---|
| 2015/0140865 | A1* | 5/2015 | Wickes | H01R 9/2408<br>439/607.28 |
| 2016/0099532 | A1* | 4/2016 | Davis | H01R 13/6585<br>439/357 |

* cited by examiner

CONNECTOR ASSEMBLY HAVING A PIN ORGANIZER

BACKGROUND OF THE INVENTION

The subject matter herein relates generally to connector assemblies having pin organizers.

Some electrical systems utilize connector assemblies, such as header assemblies and receptacle assemblies, to interconnect two circuit boards, such as a motherboard and daughtercard. The connector assemblies include contacts having pins extending from a mounting end of the connector assemblies. The pins are through-hole mounted to the circuit board by loading the pins into plated vias in the circuit board. The connector assemblies are typically pre-assembled and configured to be mounted to the circuit board. In order to ensure that the pins are oriented correctly, many connector assemblies include pin organizers that are coupled to the bottoms of the connector assemblies and that hold the pins in proper positions for mounting to the circuit board.

High speed connector assemblies suffer from problems with cross talk and can exhibit higher than desirable return loss due to geometries of the signal and ground contacts. For example, gaps or spaces in shielding through the connector assembly can result in reduced connector performance. Conventional electrical systems that utilize pin organizers suffer from shielding problems in the area of the pin organizer. For example, the thickness of the pin organizer creates an unshielded area between the bottom of the connector assembly and the top of the circuit board.

A need remains for a connector assembly having improved electrical shielding.

BRIEF DESCRIPTION OF THE INVENTION

In one embodiment, a connector assembly is provided including a shield structure and a contact module having a plurality of signal contacts each including a signal pin extending from a bottom of the contact module for terminating to a circuit board. The contact module has a plurality of ground pins forming part of the shield structure extending from the bottom of the contact module for terminating to the circuit board. The ground pins provide electrical shielding for the signal pins. A pin organizer is coupled to the contact module and includes a conductive frame and a dielectric frame coupled to the conductive frame. The dielectric frame has a plurality of plugs. The conductive frame is electrically connected to the shield structure. The conductive frame has a plurality of ground pin holes extending therethrough receiving corresponding ground pins and windows extending therethrough receiving corresponding plugs of the dielectric frame. The plugs have corresponding signal pin holes extending therethrough receiving corresponding signal pins. The plugs electrically isolate the signal pins from the conductive frame. The pin organizer substantially fills a space between the bottoms of the contact modules and the circuit board to provide electrical shielding for the signal pins between the bottoms of the contact modules and the circuit board.

In a further embodiment, a connector assembly is provided including a housing and contact modules coupled to the housing. Each contact module includes a conductive holder holding a frame assembly having a plurality of signal contacts and a dielectric frame supporting the signal contacts. The dielectric frame is received in the conductive holder. The signal contacts each include a signal pin for terminating to a circuit board. The signal pins extend from a bottom of the contact module. A ground shield is coupled to the conductive holder and is electrically connected to the conductive holder. The ground shield has ground pins extending beyond the bottom of the contact module for terminating to the circuit board. A pin organizer is coupled to the contact modules. The pin organizer includes a conductive frame and a dielectric frame coupled to the conductive frame. The dielectric frame has a plurality of plugs. The conductive frame has a plurality of ground pin holes extending therethrough receiving corresponding ground pins and windows extending therethrough receiving corresponding plugs of the dielectric frame. The plugs have corresponding signal pin holes extending therethrough receiving corresponding signal pins. The plugs electrically isolate the signal pins from the conductive frame. The pin organizer substantially fills a space between the bottoms of the contact modules and the circuit board to provide electrical shielding for the signal pins between the bottoms of the contact modules and the circuit board.

In a further embodiment, a pin organizer for a connector assembly having a plurality of signal pins and a plurality of ground pins extending from a bottom of the connector assembly is provided including a conductive frame and a dielectric frame coupled to the conductive frame. The conductive frame has conductive pads joined by longitudinal cross beams and lateral cross beams. The conductive frame has windows extending therethrough between conductive pads. The conductive frame has ground pin holes extending therethrough configured to receive corresponding ground pins. The dielectric frame has a plurality of plugs connected by tie bars. The plugs have signal pin holes extending therethrough receiving corresponding signal pins. The plugs are received in corresponding windows such that the plugs electrically isolate the signal pins from the conductive frame. Each plug is surrounded by the conductive frame such that the pads of the conductive frame provide electrical shielding circumferentially around the signal pins.

DETAILED DESCRIPTION OF THE INVENTION

Figure 1:
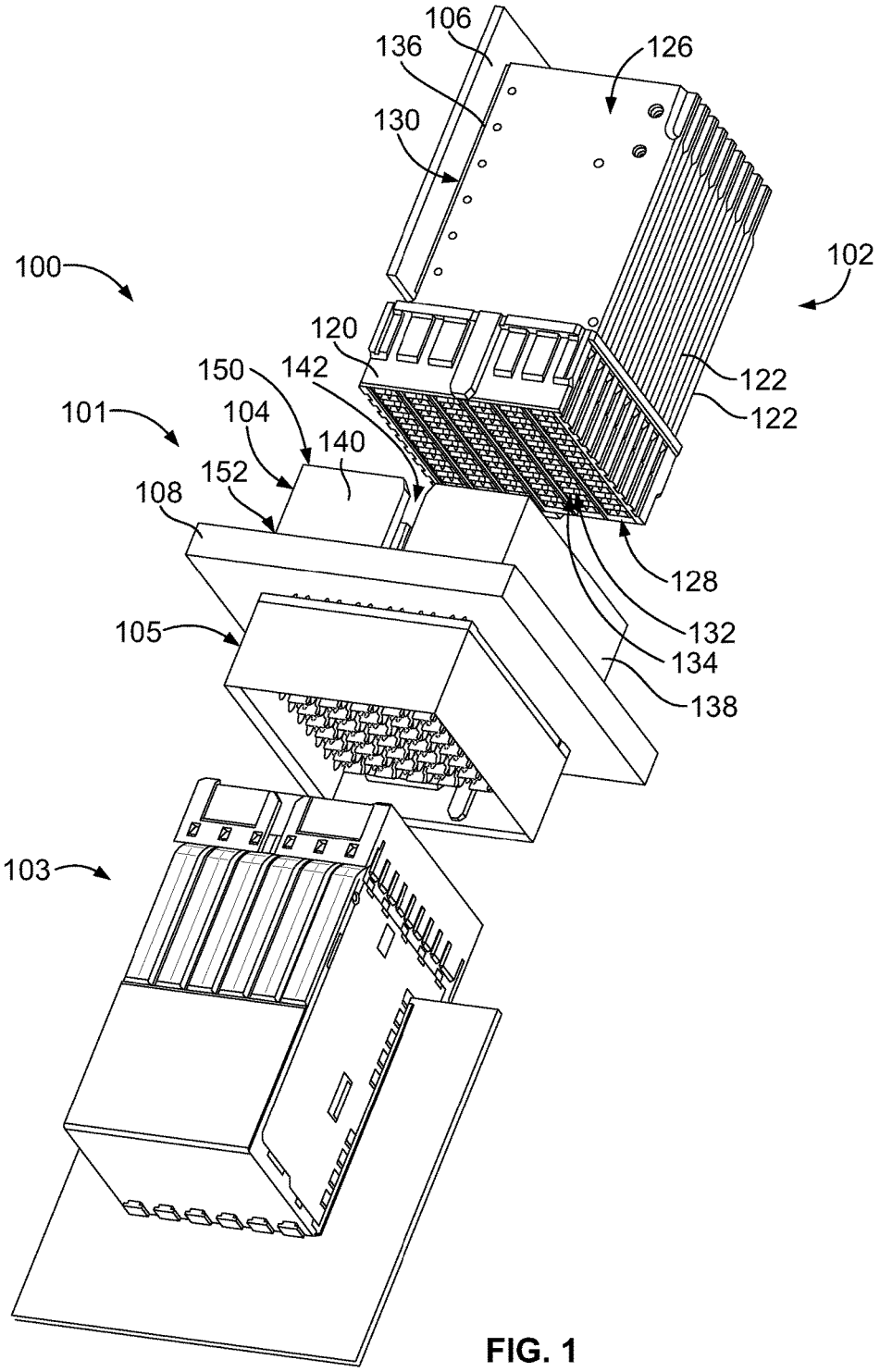
FIG. 1 is a perspective view of an electrical connector system including a receptacle assembly formed in accordance with an exemplary embodiment.

FIG. 1 is a perspective view of an electrical connector system 100 formed in accordance with an exemplary embodiment. The connector system 100 includes a midplane assembly 101. The connector system 100 includes a first connector assembly 102 configured to be coupled to a second connector assembly 104, which is part of the midplane assembly 101. The connector system 100 includes a third connector assembly 103 configured to be coupled to a fourth connector assembly 105, which is part of the midplane assembly 101.

In the illustrated embodiment, the first connector assembly 102 is a receptacle assembly and may be referred to hereinafter as a receptacle assembly 102 and the second connector assembly 104 is a header assembly and may be referred to hereinafter as a header assembly 104. In the illustrated embodiment, the third connector assembly 103 is a receptacle assembly and may be referred to hereinafter as a receptacle assembly 103 and the fourth connector assembly 105 is a header assembly and may be referred to hereinafter as a header assembly 105. Other types of connector assemblies may be used in alternative embodiments, such as a mezzanine connector, a vertical connector, a right angle connector or another type of connector. The subject matter described herein provides a pin organizer for a connector assembly, such as the receptacle assemblies 102, 103, the header assemblies 104, 105 or other types of connector assemblies.

In the illustrated embodiment, the receptacle assembly 102 is a pair-in-column receptacle assembly having pairs of signal contacts arranged in columns while the receptacle assembly 103 is a pair-in-row receptacle assembly having pairs of signal contacts arranged in rows. The receptacle assemblies 102, 103 may be similar and include similar features. The description below focuses on the receptacle assembly 102 and the header assembly 104, but may be applicable to the receptacle assembly 103 and the header assembly 105 with corresponding modifications to accommodate the different arrangement of the signal and ground contacts.

The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

The receptacle assembly 102 includes a housing 120 that holds a plurality of contact modules 122. The contact modules 122 are held in a stacked configuration generally parallel to one another. Any number of contact modules 122 may be provided in the receptacle assembly 102, including a single contact module 122. The contact modules 122 each include a plurality of signal contacts 124 (shown in FIG. 2) that define signal paths through the receptacle assembly 102. In other various embodiments, the receptacle assembly 102 may not include stacked contact modules, but rather may include a single contact module holding the signal contacts 124. The single contact module may be connected to a front housing or may be defined by the front housing with signal contacts stitched therein in an array of rows and columns. For example, the receptacle assembly 102 may be a mezzanine connector having a structure such as a housing holding a plurality of signal contacts 124, thus defining a single contact module. The signal contacts may pass straight through the receptacle assembly 102 rather than being right angle contacts.

The receptacle assembly 102 includes a front 128 defining a mating end (which may be referred to hereinafter as mating end 128) and a bottom 130 defining a mounting end (which may be referred to hereinafter as mounting end 130). The mating and mounting ends may be at different locations other than the front 128 or bottom 130 in alternative embodiments. The signal contacts 124 (shown in FIG. 2) are received in the housing 120 and held therein at the mating end 128 for electrical termination to the header assembly 104. The signal contacts 124 are arranged in a matrix of rows and columns. In the illustrated embodiment, at the mating end 128, the rows are oriented horizontally and the columns are oriented vertically. The signal contacts 124 within each column are provided within a respective same contact module 122. The signal contacts 124 within each row are provided in multiple contact modules 122. Other orientations are possible in alternative embodiments. Any number of signal contacts 124 may be provided in the rows and columns. The signal contacts 124 extend through the receptacle assembly 102 from the mating end 128 to the mounting end 130 for mounting to the circuit board 106. Optionally, the mounting end 130 may be oriented substantially perpendicular to the mating end 128; however other orientations are possible in alternative embodiments, such as parallel.

Optionally, the signal contacts 124 may be arranged in pairs carrying differential signals. In the illustrated embodiment, the pairs of signal contacts 124 are arranged in the same column (pair-in-column arrangement); however, in alternative embodiments, the pairs of signal contacts 124 may be arranged in the same row (pair-in-row arrangement). Optionally, the signal contacts 124 in the pair may be arranged within the same contact module 122.

In an exemplary embodiment, each contact module 122 has a shield structure 126 for providing electrical shielding for the signal contacts 124. The contact modules 122 may generally provide 360° shielding for each pair of signal contacts 124 along substantially the entire length of the signal contacts 124 between the mounting end 130 and the mating end 128. In an exemplary embodiment, the shield structure 126 is electrically connected to the header assembly 104 and/or the circuit board 106. For example, the shield structure 126 may be electrically connected to the header assembly 104 by extensions (for example beams and/or fingers) extending from the contact modules 122 that engage the header assembly 104. The shield structure 126 may be electrically connected to the circuit board 106 by features, such as ground pins and/or a pin organizer. In an exemplary embodiment, a portion of the shield structure 126 on one side of the contact module 122 is electrically connected to a portion of the shield structure 126 on another side of the contact module 122. For example, portions of the shield structure 126 on opposite sides of the contact module 122 may be electrically connected to each other by internal extensions (for example tabs) that extend through the interior of the contact module 122. Having the portions of the shield structure 126 on opposite sides of the contact module 122 electrically connected to each other electrically commons the portions of the shield structure 126 to provide increased performance of the signal transmission through the contact module 122. In embodiments having a single contact module, such as a mezzanine connector, the shield structure may be defined by ground contacts, ground shields, selective plating on the connector housing, or other conductive structures defining a shield structure for the signal contacts of the mezzanine connector.

In an exemplary embodiment, a pin organizer 136 is provided forming part of the shield structure 126. The pin organizer 136 may be electrically connected to other portions of the shield structure 126. The pin organizer 136 provides electrical shielding at the bottom 130 of the receptacle assembly 102. For example, the pin organizer 136 provides electrical shielding below the contact modules 122, such as between the contact modules 122 and the circuit board 106. Optionally, the pin organizer 136 may be electrically connected to the circuit board 106.

The housing 120 includes a plurality of signal contact openings 132 and a plurality of ground contact openings 134 at the mating end 128. The signal contacts 124 are received in corresponding signal contact openings 132. Optionally, a single signal contact 124 is received in each signal contact opening 132. The signal contact openings 132 may also receive corresponding header signal contacts (not shown) therein when the receptacle and header assemblies 102, 104 are mated. The ground contact openings 134 receive corresponding header ground contacts (not shown) therein when the receptacle and header assemblies 102, 104 are mated. The ground contact openings 134 also receive the extensions (for example beams and/or fingers) of the shield structure 126 of the contact modules 122 that mate with the header ground contacts to electrically common the receptacle and header assemblies 102, 104.

The housing 120 is manufactured from a dielectric material, such as a plastic material, and provides isolation between the signal contact openings 132 and the ground contact openings 134. The housing 120 isolates the signal contacts 124 and the header signal contacts from the header ground contacts. The housing 120 isolates each set of receptacle and header signal contacts from other sets of receptacle and header signal contacts. In various embodiments, the housing 120 is integral with the contact module(s) 122.

The receptacle assembly 102 includes the pin organizer 136 coupled to the bottom 130 of the receptacle assembly 102. The pin organizer 136 is used to position the signal and ground pins, and may be used to hold the relative positions of the signal and ground pins for mounting to the circuit board 106. The signal and ground pins may be press-fit pins, such as eye-of-the-needle pins; however, the signal and ground pins may be other types of pins in alternative embodiments, such as solder pins. The pin organizer 136 includes holes or openings spaced apart in an array corresponding to a particular pinout of vias in the circuit board 106 to which the receptacle assembly 102 is mounted. The pin organizer 136 is captured between the bottom 130 of the receptacle assembly 102 and the circuit board 106 when the receptacle assembly 102 is mounted to the circuit board 106. The pin organizer 136 substantially fills the space between the bottoms of the contact modules 122 and the circuit board 106 to provide electrical shielding for the signal contacts 124 between the bottoms of the contact modules 122 and the circuit board 106. In an exemplary embodiment, the pin organizer 136 is at least partially manufactured from a conductive material, such as a metal material or a metalized plastic material to provide electrical shielding in the transition or mating zone of the receptacle assembly 102 with the circuit board 106. In an exemplary embodiment, the pin organizer 136 is electrically connected to the shield structure 126 and/or is electrically connected to the circuit board 106, such as to a ground layer or ground pads on the surface of the circuit board 106.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. A pin organizer similar to the pin organizer 136 may be provided between the mounting end 152 and the circuit board 108. The receptacle assembly 102 is configured to be received in the chamber 142 through the mating end 150. The housing 120 engages the walls 140 to hold the receptacle assembly 102 in the chamber 142. The header signal contacts (not shown) and the header ground contacts (not shown) extend into the chamber 142 for mating with the receptacle assembly 102. The header ground contacts provide electrical shielding around corresponding header signal contacts. The header signal contacts may be arranged in rows and columns on the header assembly 104. In an exemplary embodiment, the header signal contacts are arranged in pairs configured to convey differential signals. Optionally, the header ground contacts may peripherally surround a corresponding pair of the header signal contacts to provide electrical shielding. For example, the header ground contacts may be C-shaped or L-shaped, cooperating to cover multiple sides of the header signal contacts.

Figure 2:
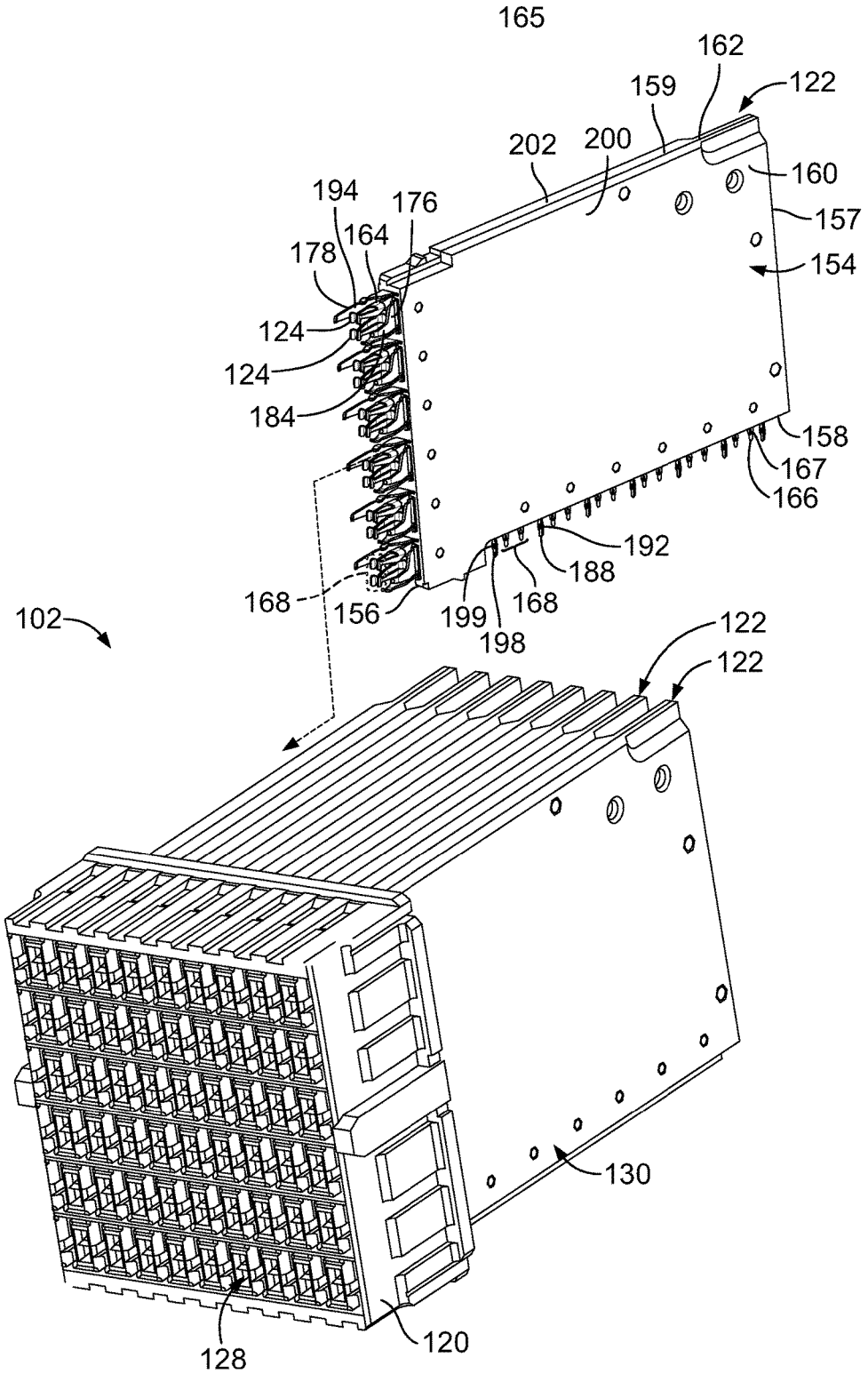
FIG. 2 is an exploded view of the receptacle assembly showing a contact module.
Figure 3:
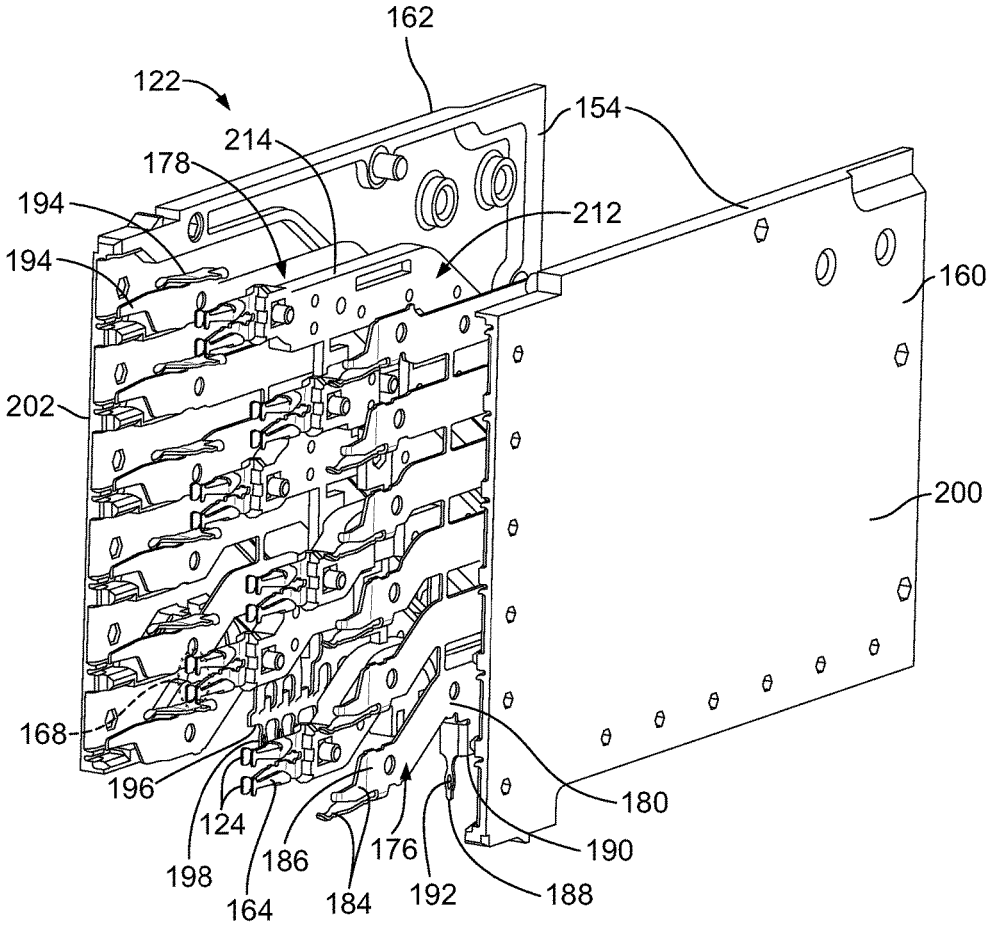
FIG. 3 is an exploded perspective view of the contact module.

FIG. 2 is an exploded view of the receptacle assembly 102 showing one of the contact modules 122 poised for loading into the housing 120. FIG. 3 is an exploded perspective view of the contact module 122. The contact modules 122 may be loaded side-by-side and parallel to each other in a stacked configuration.

In an exemplary embodiment, the contact module 122 includes a conductive holder 154, which defines at least a portion of the shield structure 126. The conductive holder 154 generally surrounds the signal contacts 124 along substantially the entire length of the signal contacts 124 between the mounting end 130 and the mating end 128. With reference to FIG. 2, the conductive holder 154 has a front 156 configured to be loaded into the housing 120, a rear 157 opposite the front 156, a bottom 158 that faces the circuit board 106 and the pin organizer 136 (both shown in FIG. 1), and a top 159 generally opposite the bottom 158. The bottom 158 of the conductive holder 154 may define a bottom of the contact module 122. The bottom 158 of the conductive holder 154 may define the bottom 130 of the receptacle assembly 102. The conductive holder 154 also defines right and left exterior sides 160, 162, as viewed from the front.

The conductive holder 154 is fabricated from a conductive material that provides electrical shielding for the receptacle assembly 102. For example, the conductive holder 154 may be die-cast, or alternatively stamped and formed, from a metal material. In other alternative embodiments, the holder 154 may be fabricated from a plastic material that has been metalized or coated with a metallic layer. In other embodiments, rather than a conductive holder, the holder 154 may be non-conductive. In other embodiments, the contact module 122 may be provided without the conductive holder 154 altogether.

The signal contacts 124 have mating portions 164 extending forward from the front 156 of the conductive holder 154. The mating portions 164 are configured to be electrically terminated to corresponding header signal contacts when the receptacle assembly 102 and header assembly 104 (shown in FIG. 1) are mated. In an exemplary embodiment, the other ends of the signal contacts 124 extend downward from the bottom 158 of the conductive holder 154 as signal pins 166 (FIG. 2) or simply pins 166. The signal pins 166 electrically connect the contact module 122 to the circuit board 106 (shown in FIG. 1). The signal pins 166 are configured to be terminated to the circuit board 106. For example, the signal pins 166 may be through-hole mounted to the circuit board 106. The signal pins 166 may be compliant pins, such as eye-of-the-needle pins. For example, the signal pins 166 have enlarged areas 167 that are configured to engage corresponding plated vias of the circuit board 106 by an interference fit to mechanically and electrically couple the signal pins 166 to the circuit board 106. The signal pins 166 may be other types of pins in alternative embodiments, such as solder pins. Optionally, in some embodiments, rather than being signal pins, at least some of the pins 166 may be ground pins that are part of ground contacts forming part of the shield structure 126. In the illustrated embodiment, the mating portions 164 extend generally perpendicular with respect to the signal pins 166; however, other orientations are possible in alternative embodiments. In an exemplary embodiment, the signal contacts 124 in each contact module 122 are arranged as contact pairs 168 configured to transmit differential signals through the contact module 122.

In an exemplary embodiment, each contact module 122 includes first and second ground shields 176, 178, which define at least a portion of the shield structure 126. The ground shields 176, 178 may be positioned along interior surfaces or exterior surfaces of the sides 160, 162 of the conductive holder 154. For example, the first ground shield 176 may be positioned along the right side 160 of the conductive holder 154, and as such, may be hereinafter referred to as the right ground shield 176. The second ground shield 178 may be positioned along the left side 162 of the conductive holder, and may be hereinafter referred to as the left ground shield 178. The ground shields 176, 178 are configured to provide electrical shielding for the signal contacts 124. The ground shields 176, 178 electrically connect the contact module 122 to the header ground contacts, thereby electrically commoning the connection across the receptacle assembly 102 and header assembly 104 (shown in FIG. 1). Optionally, a single ground shield may be used rather than two ground shields. Alternatively, the contact module 122 may not include any ground shields.

The right ground shield 176 is coupled to the right side 160 of the conductive holder 154. When attached to the conductive holder 154, the right ground shield 176 electrically connects to the conductive holder 154. The right ground shield 176 includes a main body 180 that is generally planar and extends alongside of the conductive holder 154. The right ground shield 176 includes grounding beams 184 extending from a front 186 of the main body 180. The right ground shield 176 includes ground pins 188 extending from a bottom 190 of the main body 180. In an exemplary embodiment, the ground pins 188 are configured to be electrically connected to the pin organizer 136 (shown in FIG. 1). The ground pins 188 are configured to be terminated to the circuit board 106 (shown in FIG. 1). For example, the ground pins 188 may be through-hole mounted to the circuit board 106. The ground pins 188 may be compliant pins, such as eye-of-the-needle pins. The ground pins 188 have enlarged areas 192 that are configured to engage corresponding plated vias of the circuit board 106 by an interference fit to mechanically and electrically couple the ground pins 188 to the circuit board 106. The ground pins 188 may be other types of pins in alternative embodiments, such as solder pins.

The left ground shield 178 (FIG. 3) may be similar to the right ground shield 176. The left ground shield 178 may be a mirrored version of the right ground shield 176. The left ground shield 178 is coupled to the left side 162 of the conductive holder 154. The left ground shield 178 includes a main body 182 that is generally planar and extends alongside of the conductive holder 154. The left ground shield 178 includes grounding beams 194 extending from a front of the main body 182. The left ground shield 178 includes ground pins 198 extending from a bottom 196 of the main body 182. In an exemplary embodiment, the ground pins 198 are configured to be electrically connected to the pin organizer 136. The ground pins 198 are configured to be terminated to the circuit board 106 (shown in FIG. 1). For example, the ground pins 198 may be through-hole mounted to the circuit board 106. The ground pins 198 may be compliant pins, such as eye-of-the-needle pins. The ground pins 198 have enlarged areas 199 that are configured to engage corresponding plated vias of the circuit board 106 by an interference fit to mechanically and electrically couple the ground pins 198 to the circuit board 106. The ground pins 198 may be other types of pins in alternative embodiments, such as solder pins.

In an exemplary embodiment, the right and left ground shields 176, 178 are manufactured from a metal material. The ground shields 176, 178 are stamped and formed parts with the grounding beams 184, 194 being stamped and then formed during a forming process. The ground pins 188, 198 are stamped and/or formed.

The conductive holder 154 shown in the illustrated embodiment includes a right holder member 200 and a left holder member 202. Upon assembling the contact module 122, the right and left holder members 200, 202 are coupled together to form the conductive holder 154. The right and left ground shields 176, 178 are coupled to the right and left holder members 200, 202, respectively. The right ground shield 176 engages and is electrically connected to the right holder member 200. The left ground shield 178 (FIG. 3) engages and is electrically connected to the left holder member 202. In various embodiments, the ground shields 176, 178 and/or the holder members 200, 202 may be electrically connected to the pin organizer 136.

As a part of the shield structure 126, the holder members 200, 202 generally provide electrical shielding between and around respective signal contacts 124. For example, the holder members 200, 202 provide shielding from electromagnetic interference (EMI) and/or radio frequency interference (RFI), and may provide shielding from other types of interference as well. The holder members 200, 202 may provide shielding around the outside of the signal contacts 124 as well as between the signal contacts 124. As a result, the holder members 200, 202 allow for better control of electrical characteristics, such as impedance, cross-talk, and the like, of the signal contacts 124.

The conductive holder 154 holds a frame assembly 212, which includes the signal contacts 124. Upon assembly of the contact module 122, the frame assembly 212 is received in the right and left holder members 200, 202. The holder members 200, 202 provide shielding around the frame assembly 212 and signal contacts 124. The holder members 200, 202 are configured to extend into the frame assembly 212 such that the holder members 200, 202 are positioned between signal contact pairs 168 to provide shielding between adjacent contact pairs 168.

The frame assembly 212 includes a dielectric frame 214 surrounding and supporting the signal contacts 124. The signal contacts 124 of each contact pair 168 extend through the dielectric frame 214 generally along parallel paths. In an exemplary embodiment, the signal contacts 124 are initially held together as a leadframe (not shown), which is overmolded with dielectric material to form the dielectric frame 214. Manufacturing processes other than overmolding a leadframe may be utilized to form the dielectric frame 214, such as loading signal contacts 124 into a formed dielectric body. In various alternative embodiments, the ground shields 176 and/or 178 may be coupled directly to the dielectric frame 214 without the need for the conductive holder 154. In embodiments having a single contact module, such as a mezzanine connector, the dielectric frame 214 may be defined by the connector housing with the signal contacts 124 stitched or otherwise received therein.

Figure 4:
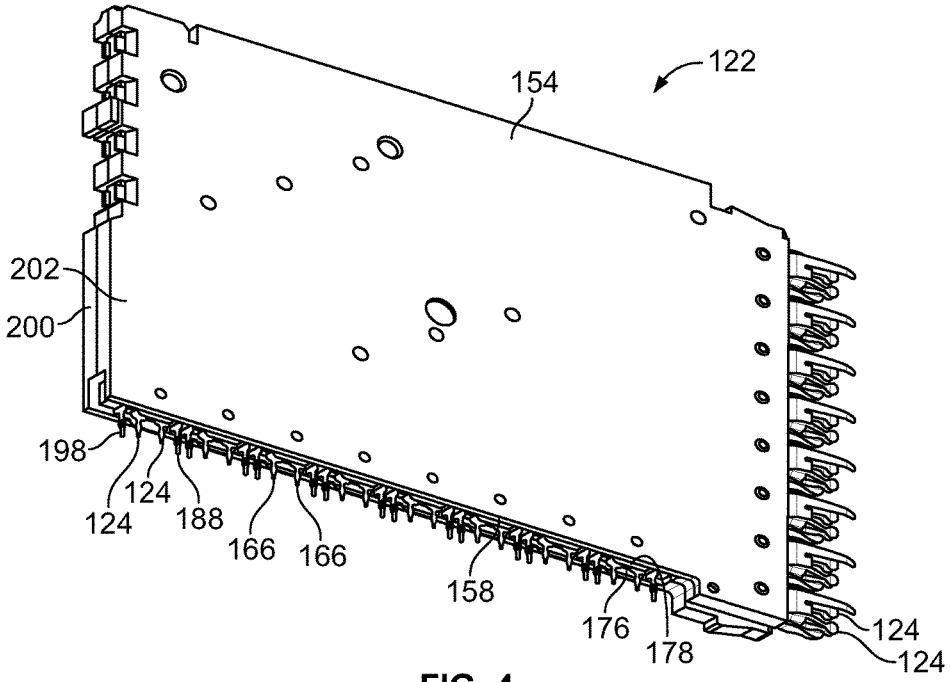
FIG. 4 is a bottom perspective view of the contact module in accordance with an exemplary embodiment in an assembled state.

FIG. 4 is a bottom perspective view of one of the contact modules 122 in accordance with an exemplary embodiment in an assembled state. The contact module 122 includes the signal pins 166 and the ground pins 188, 198 at the bottom of the contact module 122. The ground pins 188, 198 are bent into a common plane with the signal pins 166 such that the ground pins 188, 198 and the signal pins 166 are aligned with each other in a row. The ground shields 176, 178 are electrically connected to the conductive holder members 200, 202 to provide electrical shielding for the signal contacts 124. The bottoms 190, 196 of the ground shields 176, 178 are configured to be mechanically and electrically connected to the pin organizer 136. The bottom 158 of the conductive holder 154 is configured to be mechanically and electrically connected to the pin organizer 136.

Figure 5:
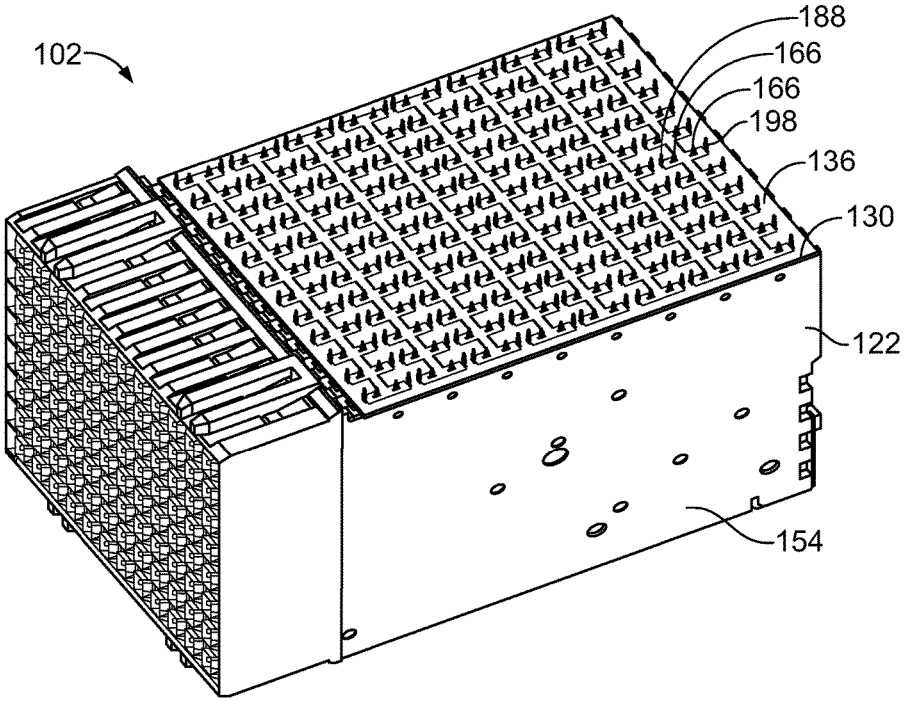
FIG. 5 is a bottom perspective view of the receptacle assembly showing a pin organizer in accordance with an exemplary embodiment coupled to the bottom of the receptacle assembly.

FIG. 5 is a bottom perspective view of the receptacle assembly 102 in accordance with an exemplary embodiment showing the pin organizer 136 coupled to the bottom 130 of the receptacle assembly 102. The pin organizer 136 is positioned below the contact modules 122. The signal pins 166 and ground pins 188, 198 pass through the pin organizer 136 for termination to the circuit board 106 (shown in FIG. 1). The ground shields 176, 178 may be electrically connected to the pin organizer 136. The conductive holder 154 may be electrically connected to the pin organizer 136.

Figure 6:
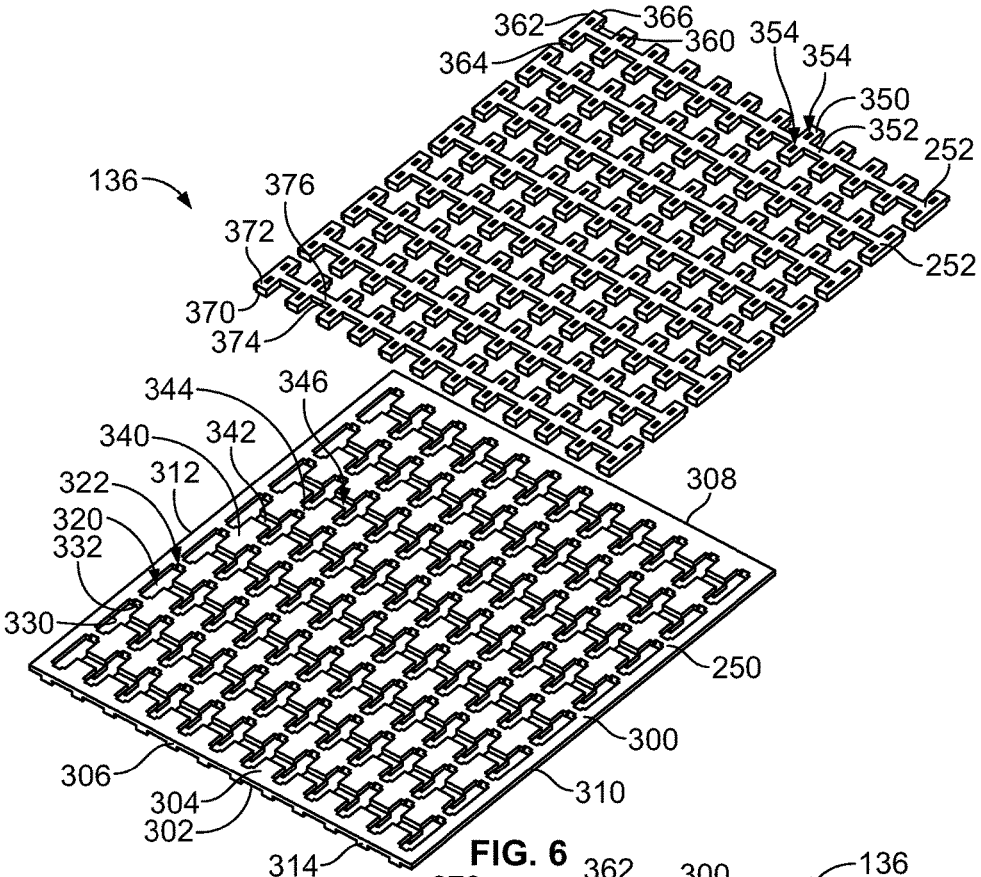
FIG. 6 is an exploded, bottom perspective view of the pin organizer formed in accordance with an exemplary embodiment.
Figure 7:
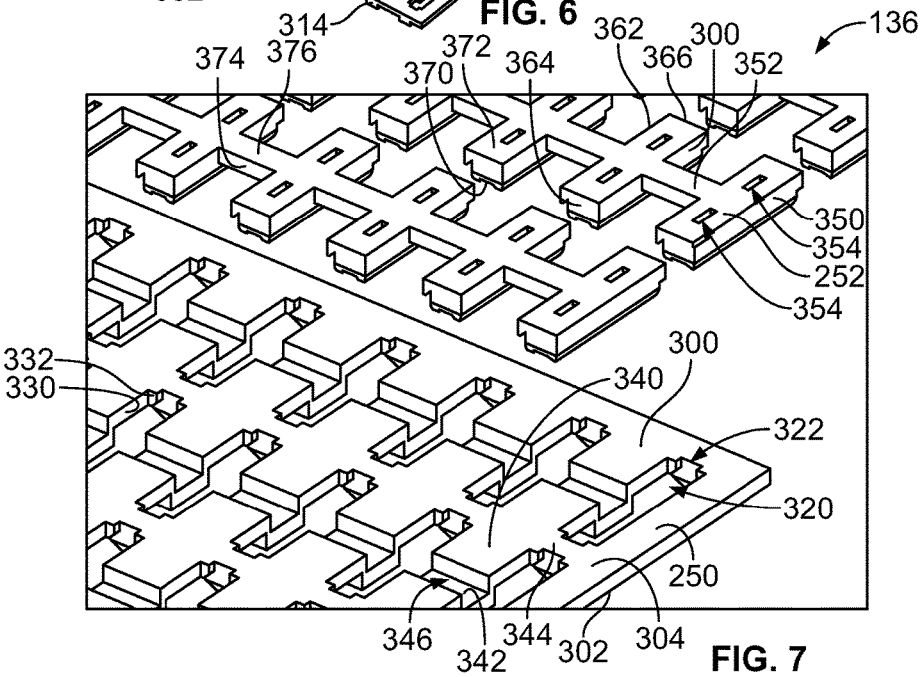
FIG. 7 is an enlarged exploded, bottom perspective view of a portion of the pin organizer.

FIG. 6 is an exploded, bottom perspective view of the pin organizer 136 formed in accordance with an exemplary embodiment. FIG. 7 is an enlarged exploded, bottom perspective view of a portion of the pin organizer 136. The pin organizer 136 includes a conductive frame 250 and one or more dielectric frames 252 coupled to the conductive frame 250. In the illustrated embodiment, the pin organizer 136 includes eight discrete dielectric frames 252 corresponding to the number of pairs of signal contacts 124 in the receptacle assembly 102. The pin organizer 136 may include greater or fewer dielectric frames 252 in alternative embodiments. In other various embodiments, rather than being discreet dielectric frames 252, the pin organizer 136 may include a single, unitary dielectric frame 252 received in the conductive frame 250. For example, the discrete dielectric frames 252 illustrated in FIGS. 6 and 7 may be connected by tie bars or other structures. The dielectric frames 252 are configured to receive the signal pins 166 (shown in FIG. 2) and the conductive frame 250 is configured to receive the ground pins 188, 198 (shown in FIG. 2). The conductive frame 250 provides electrical shielding around the signal pins 166. The dielectric frames 250 to electrically isolate the signal pins 166 from the conductive frame 250.

The conductive frame 250 includes a base or plate 300 having a top 302, bottom 304, front 306, rear 308 and opposite sides 310, 312. The conductive frame 250 includes edges 314 extending between the top 302 and the bottom 304 along the front 306, rear 308 and sides 310, 312. The top 302 is configured to engage the bottoms 158 of the contact modules 122 (both shown in FIG. 2) to locate the pin organizer 136 relative to the contact modules 122.

The conductive frame 250 is conductive to provide electrical shielding for the signal pins 166 (shown in FIG. 2) passing through the pin organizer 136. For example, the conductive frame 250 may be fabricated from a plastic material that has been metalized or coated with a metallic layer. In alternative embodiments, the conductive frame 250 may be die-cast, or alternatively stamped and formed, from a metal material. In an exemplary embodiment, the conductive frame 250 is conductive through the plate 300 to provide electrical shielding at the top 302, at the bottom 304 and therebetween.

The conductive frame 250 includes a plurality of windows 320 extending through the plate 300 between the top 302 and bottom 304 configured to receive portions of the dielectric frame 252. The conductive frame 250 includes ground pin holes 322 extending through the plate 300 between the top 302 and bottom 304 configured to receive corresponding ground pins 188, 198. The ground pin holes 322 are spaced apart in an array corresponding to a particular pinout of vias (not shown) in the circuit board 106 (shown in FIG. 1) to which the receptacle assembly 102 is mounted. The conductive frame 250 may hold the positions of the ground pins 188, 198 for mounting to the circuit board 106. The ground pins 188, 198 are configured to extend through the plate 300 beyond the bottom 304 of the conductive frame 250. In the illustrated embodiment, the ground pin holes 322 are positioned in a row with the windows 320. Optionally, the ground pin holes 322 may be open to the windows 320 such that the ground pin holes 322 and the windows 320 are part of the same cut-out in the conductive frame 250. Alternatively, the ground pin holes 322 may be separate cutouts from the windows 320. The ground pin holes 322 may be located at other positions, such as non-aligned with the windows 320 in other embodiments. In an exemplary embodiment, the ground pin holes 322 have chamfered lead-ins at the top 302 for loading the ground pins 188, 198 into the ground pin holes 322.

In an exemplary embodiment, the windows 320 are oversized relative to the signal pins 166 that the windows 320 receive. For example, the windows 320 are designed to accommodate portions of the dielectric frame 252 in addition to the signal pins 166. The windows 320 are defined by side edges 330 and end edges 332. The edges 330, 332 are configured to be electrically isolated from the signal pins 166, such as with portions of the dielectric frame 252 therebetween, to ensure that the conductive frame 250 remains spaced apart from the signal pins 166 to avoid short circuiting and to control integrity of the signals. Optionally, the windows 320 may have chamfered lead-ins at the top 302 to receive the dielectric frames 252.

The conductive frame 250 includes a plurality of pads 340 defining the windows 320 and the ground pin holes 322. The pads 340 are connected by longitudinal cross beams 342 and lateral cross beams 344. The longitudinal cross beams 342 and/or the lateral cross beams 344 may define portions of the windows 320 and/or the ground pin holes 322. Optionally, each window 320 may be defined by a plurality of pads 340, a plurality of longitudinal cross beams 342 and a plurality of lateral cross beams 344 defining different portions of the side edges 330 and the end edges 332.

In an exemplary embodiment, the conductive frame 250 includes channels 346 extending between the windows 320. The channels 346 receive portions of the dielectric frames 252. The channels 346 are recessed into the bottom 304 of the plate 300 to allow the dielectric frames 252 to be in set in the conductive frame 250. In the illustrated embodiment, the channels 346 extend along the columns of windows 320. In other various embodiments, the channels 346 may additionally or alternatively extend along the rows of windows 320. In the illustrated embodiment, the channels 346 extend along the bottoms of the lateral cross beams 344. The channels 346 are positioned between pads 340.

Each dielectric frame 252 includes plugs 350 connected by tie bars 352; however, various embodiments may provide dielectric frames 252 having plugs 350 separate from each other without tie bars 352 therebetween that are individually loaded into windows 320 in the conductive frame 250. The plugs 350 include signal pin holes 354 that receive corresponding signal pins 166 (shown in FIG. 2). In the illustrated embodiment, each plug 350 includes a pair of signal pin holes 354 configured to receive corresponding pair of signal pins 166. However, the plugs 350 may include a single signal pin hole 354 in alternative embodiments. The signal pin holes 354 are aligned in rows. The plugs 350 are connected by the tie bars 352 in columns.

In an exemplary embodiment, the plugs 350 include sides 360, 362 and ends 364, 366. The sides 360, 362 are longer than the ends 364, 366. Optionally, the signal pin holes 354 may be elongated in a direction parallel to the sides 360, 362. The signal pin holes 354 may be aligned in rows parallel to the sides 360, 362. The tie bars 352 extend between the sides 360, 362 of adjacent plugs 350. In the illustrated embodiment, the plugs 350 are generally rectangular; however, the plugs 350 may have other shapes in alternative embodiments. Optionally, the corners of the plugs 350 may be rounded.

Each plug 350 has a top 370 and a bottom 372. Each tie bars 352 has a top 374 and a bottom 376. Optionally, the bottoms 372, 376 may be generally coplanar. Optionally, the top 370 of the plug 350 may extend above the top 370 of the tie bar 352. Optionally, the sides 360, 362 and/or the ends 364, 366 at the top 370 may be chamfered for loading the dielectric frame 252 into the conductive frame 250.

During assembly, the plugs 350 are aligned with corresponding windows 320 and the tie bars 352 are aligned with corresponding channels 346. In an exemplary embodiment, the dielectric frame 252 is loaded into the conductive frame 250 from above. The plugs 350 are received in corresponding windows 320 with the tie bars 352 being received in corresponding channels 346.

Figure 8:
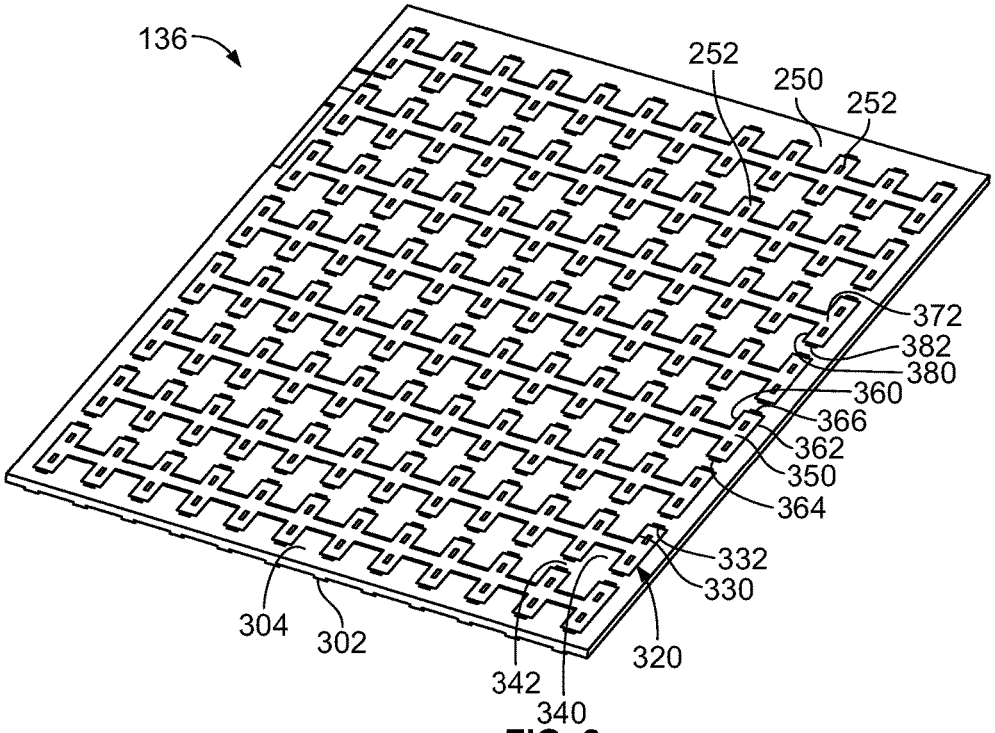
FIG. 8 is a bottom perspective view of the pin organizer showing a dielectric frame and a conductive frame thereof.
Figure 9:
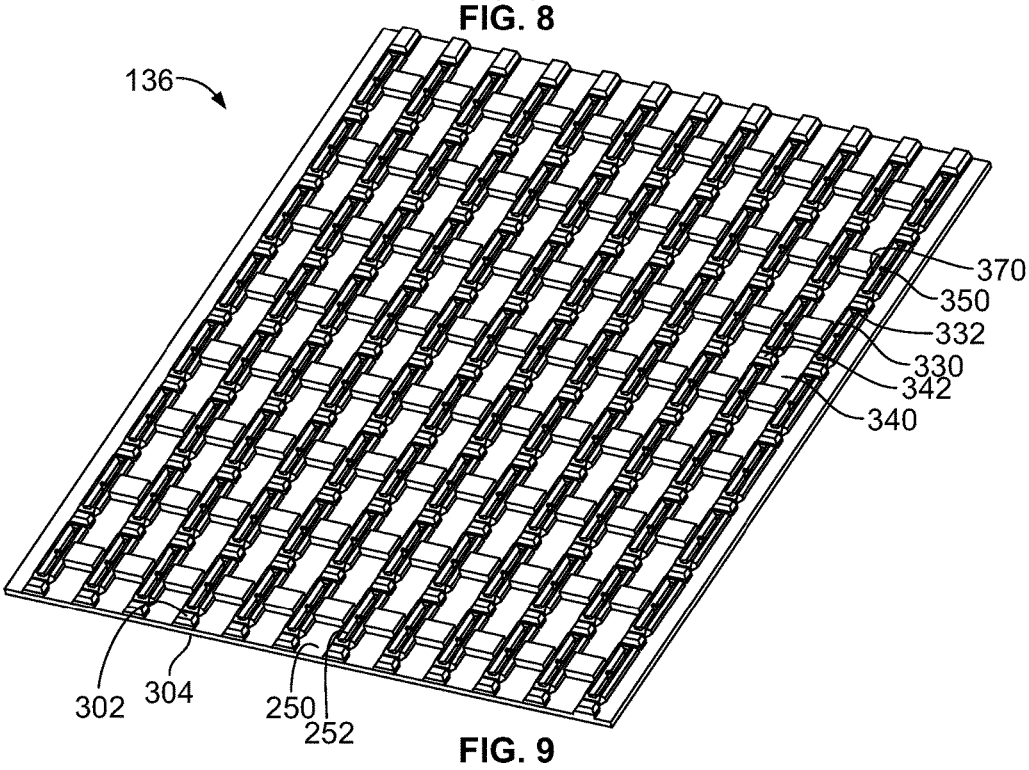
FIG. 9 is a top perspective view of the pin organizer showing the dielectric frame and the conductive frame.

FIG. 8 is a bottom perspective view of the pin organizer 136 showing the dielectric frames 252 loaded in the conductive frame 250. FIG. 9 is a top perspective view of the pin organizer 136 showing the dielectric frames 252 loaded in the conductive frame 250. When assembled, the dielectric frames 252 are embedded in the conductive frame 250. The dielectric frames 252 may be held in the conductive frame 250 by an interference fit or by some other mechanical securing means, such as adhesive. Optionally, the bottoms 372 of the plugs 350 may be generally coplanar with the bottom 304 of the conductive frame 250. Optionally the tops 370 of the plugs 350 may be generally coplanar with the top 302 of the conductive frame 250.

In an exemplary embodiment, the plugs 350 include side locating features 380 and the end locating features 382 for locating the plugs 350 relative to the conductive frame 250. For example, the plugs 350 may include the side locating features 380 along the side 360 and/or the side 362. The side locating features 380 may be defined by the sides 360 and/or 362. Alternatively, the side locating features 380 may be bumps or protrusions extending from the sides 360 and/or 362. For example, the side locating features 380 may be crush ribs along the sides 360 and/or 362. The plugs 350 may include the end locating features 382 along the end 364 and/or the end 366. The end locating features 382 may be defined by the ends 364 and/or 366. Alternatively, the end locating features 382 may be bumps or protrusions extending from the ends 364 and/or 366. For example, the end locating features 382 may be crush ribs along the ends 364 and/or 366. Optionally, the side locating features 380 may be provided on the conductive frame 250 rather than the dielectric frame 252. For example, the side locating features 380 may be provided along the side edges 330 of the window 320. Optionally, the end locating features 382 may be provided on the conductive frame 250 rather than the dielectric frame 252. For example, the end locating features 382 may be provided along the end edges 332 of the window 320.

When assembled, the conductive frame 250 provides electrical shielding between corresponding signal pins 166 (shown in FIG. 2). For example, the pads 340 are located between adjacent plugs 350 and thus provide shielding between corresponding signal pins 166 in the same column. The longitudinal crossbars 342 are located between adjacent plugs 350 and thus provides shielding between corresponding signal pins 166 in the same row. The dielectric material of the dielectric frames 252 provide a dielectric barrier between the signal pins 166 and the conductive frame 250 to electrically isolate the signal pins 166 from the conductive frame 250.

Figure 10:
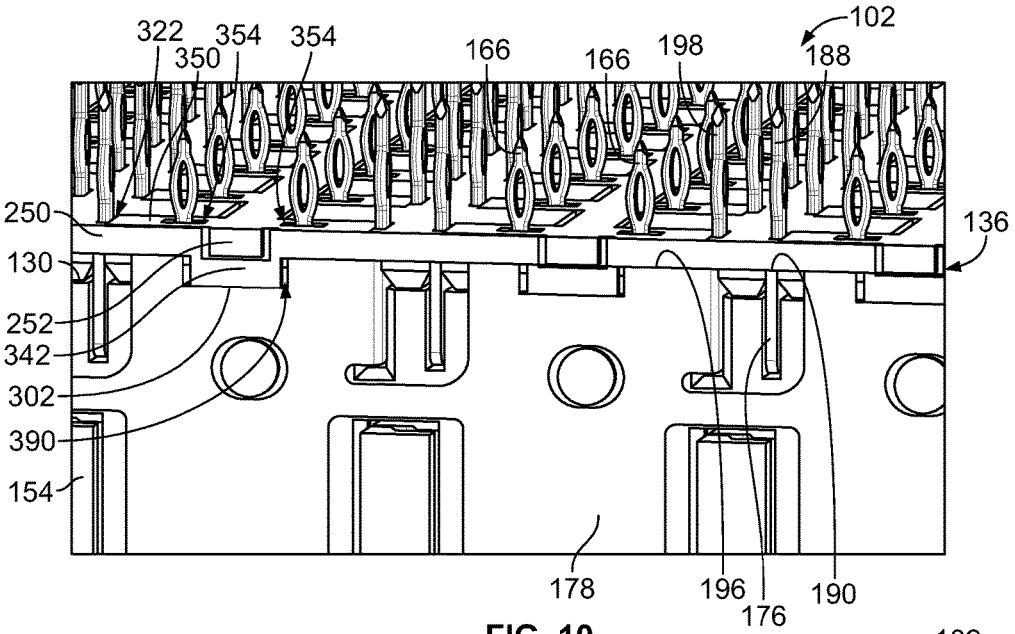
FIG. 10 is a partial sectional view of a portion of the receptacle assembly in accordance with an exemplary embodiment showing the pin organizer mounted to the bottom of the receptacle assembly.
Figure 11:
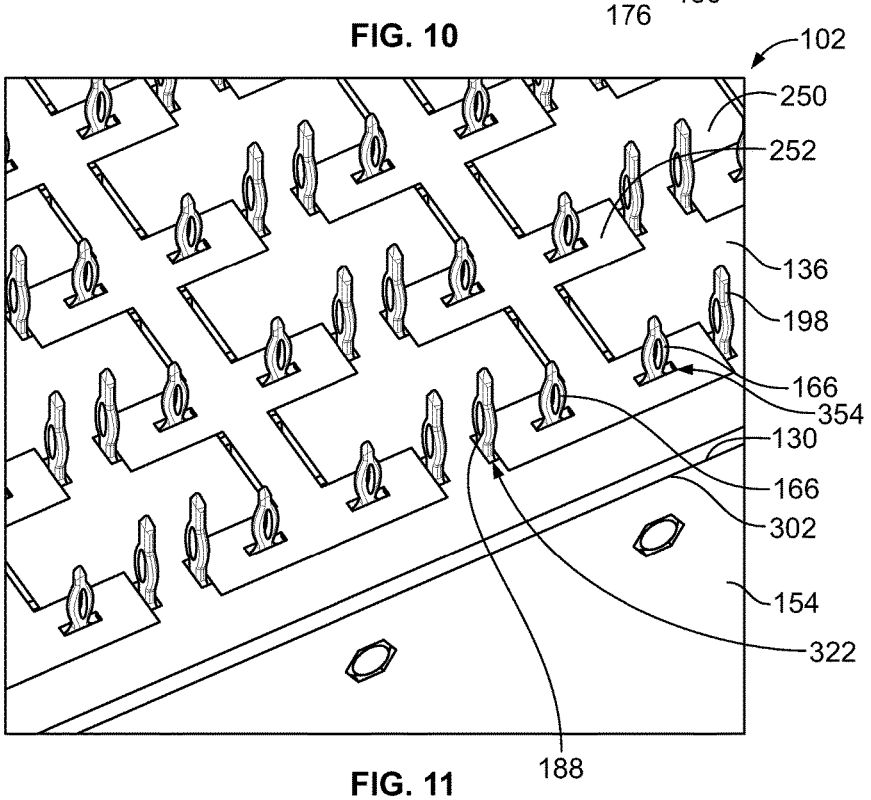
FIG. 11 is a bottom perspective view of a portion of the receptacle assembly showing the pin organizer mounted to the bottom of the receptacle assembly.

FIG. 10 is a partial sectional view of a portion of the receptacle assembly 102 in accordance with an exemplary embodiment showing the pin organizer 136 mounted to the bottom 130 of the receptacle assembly 102. FIG. 11 is a bottom perspective view of a portion of the receptacle assembly 102 showing the pin organizer 136 mounted to the bottom 130 of the receptacle assembly 102.

The signal pins 166 pass through the signal pin holes 354 and are surrounded by the dielectric material of the plugs 350 of the dielectric frame 252 to electrically isolate the signal pins 166 from the conductive frame 250. The ground pins 188, 198 pass through the ground pin holes 322 below the pin organizer 136 for mounting to the circuit board 106.

In an exemplary embodiment, the ground pins 188, 198 directly engage the conductive frame 250 to electrically connect each of the ground pins 188, 198 to the conductive frame 250, and thus to each other. In an exemplary embodiment, the conductive frame 250 is electrically connected to the ground shields 176, 178. For example, the bottoms 190, 196 of the ground shields 176, 178 may rest on and abut against the top 302 of the conductive frame 250 to electrically connect each of the ground shields 176, 178 to the conductive frame 250, and thus to each other. Optionally, the conductive frame 250 may directly engage the conductive holder 154 (shown in FIG. 2) to electrically connect the conductive holder 154 to the conductive frame 250. In an exemplary embodiment, the ground shield 176 includes shield channels 390 receiving the corresponding longitudinal cross beams 342.

Figure 12:
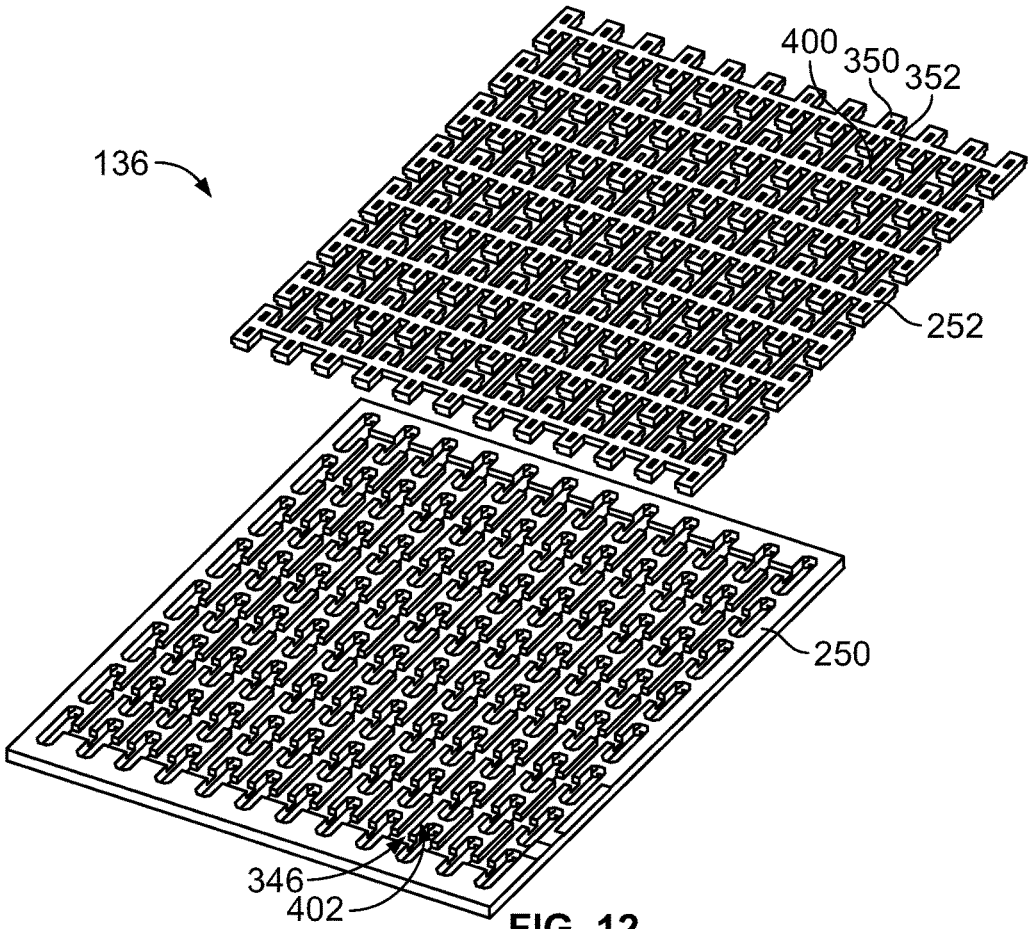
FIG. 12 is an exploded, bottom perspective view of the pin organizer formed in accordance with an exemplary embodiment.

FIG. 12 is an exploded, bottom perspective view of the pin organizer 136 formed in accordance with an exemplary embodiment. In the illustrated embodiment, the pin organizer 136 includes transverse tie bars 400 connecting the dielectric frames 252. The transverse tie bars 400 extend between corresponding tie bars 352. As such, the dielectric frame 252 is a single unitary structure configured to be coupled to the conductive frame 250. For example, each of the plugs 350 are co-molded with each other and with the tie bars 352 and transverse tie bars 400.

In the illustrated embodiment, the conductive frame 250 includes transverse channels 402 that receive corresponding transverse tie bars 400. The transverse channels 402 extend between corresponding channels 346. In an exemplary embodiment, the channels 346 and the transverse channels 402 are sized and shaped to receive the tie bars 352 and the transverse tie bars 400, respectively. Optionally, the channels 346 and the transverse channels 402 may be oversized relative to the tie bars 352 and the transverse tie bars 400 to allow positioning or floating of the tie bars 352 and the transverse tie bars 400 in the channels 346 and the transverse channels 402, respectively.

Figure 13:
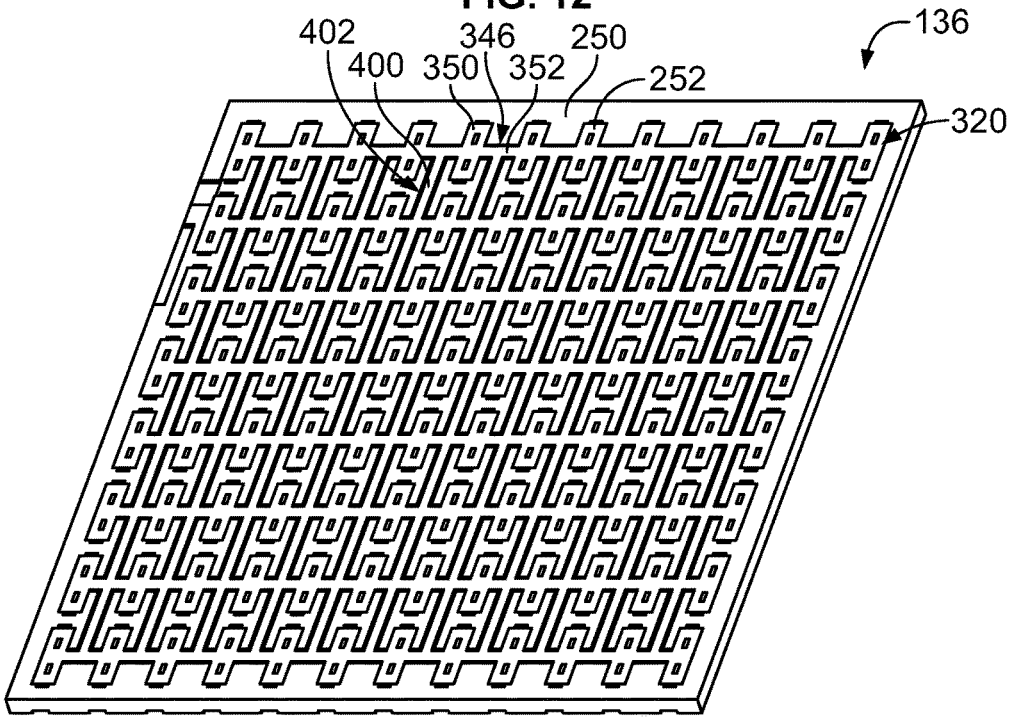
FIG. 13 is a bottom perspective view of the pin organizer showing the dielectric frame loaded in the conductive frame.
Figure 14:
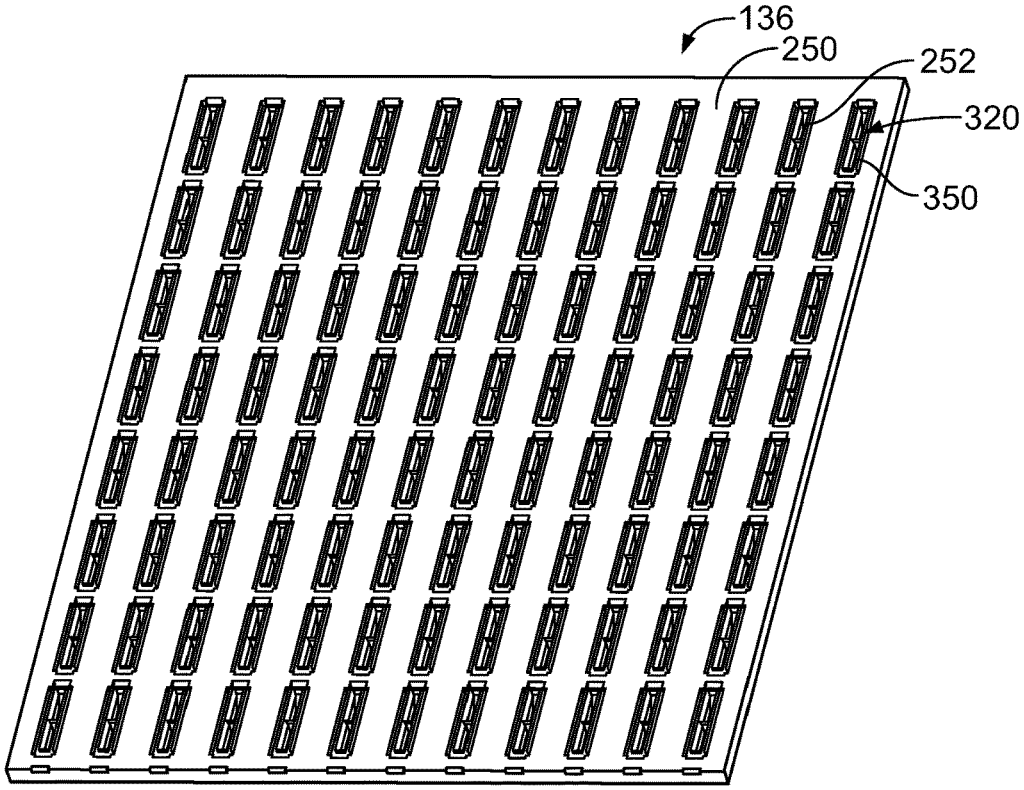
FIG. 14 is a top perspective view of the pin organizer showing the dielectric frame loaded in the conductive frame.

FIG. 13 is a bottom perspective view of the pin organizer 136 showing the dielectric frame 252 loaded in the conductive frame 250. FIG. 14 is a top perspective view of the pin organizer 136 showing the dielectric frame 252 loaded in the conductive frame 250. When assembled, the channels 346 received the tie bars 352 and the transverse channels 402 receive the transverse tie bars 400. Each of the plugs 350 may be received in corresponding windows 320 at the same time because the dielectric frame 252 is a single unitary structure.

Figure 15:
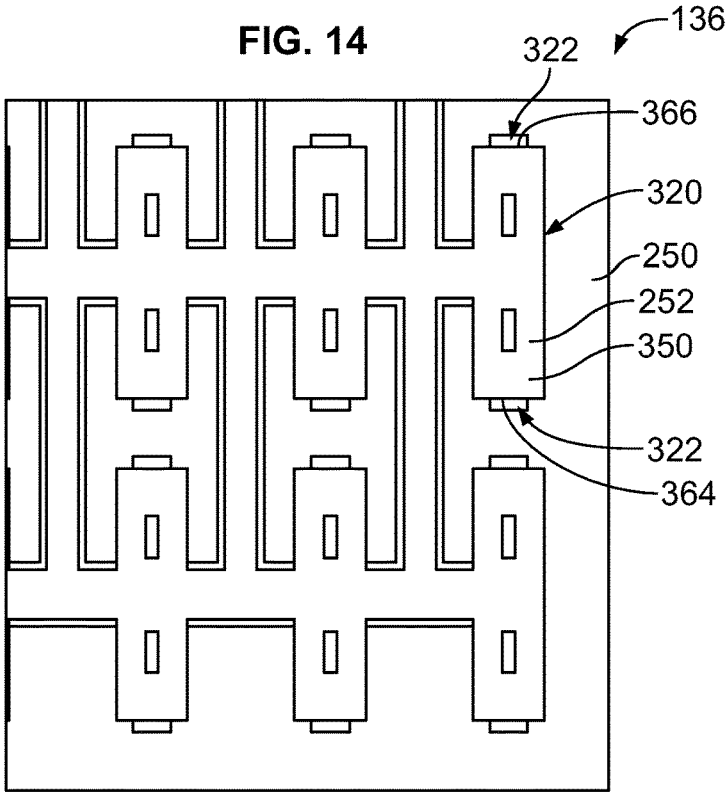
FIG. 15 is a bottom view of a portion of the pin organizer showing the dielectric frame loaded in the conductive frame.

FIG. 15 is a bottom view of a portion of the pin organizer 136 showing the dielectric frame 252 loaded in the conductive frame 250. When assembled, the plugs 350 substantially fill the windows 320. Optionally, the ground pin holes 322 are provided at the ends of the window 320. The plugs 350 may close off the ground pin holes 322. Optionally, when the ground pins 188, 198 (shown in FIG. 2) are received in the ground pin holes 322, the ends 364, 366 of the plugs 350 may engage the ground pins 188, 198 and/or may press the ground pins 188, 198 into the ground pin holes 322 against the conductive frame 250.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A connector assembly comprising:

a shield structure;

a contact module having a plurality of signal contacts, the signal contacts each including a signal pin for terminating to a circuit board, the signal pins extending from a bottom of the contact module, the contact module having a plurality of ground pins forming part of the shield structure extending from the bottom of the contact module for terminating to the circuit board, the ground pins providing electrical shielding for the signal pins; and a pin organizer coupled to the contact module, the pin organizer comprising a conductive frame and a dielectric frame coupled to the conductive frame, the dielectric frame having a plurality of plugs, the conductive frame being electrically connected to the shield structure, the conductive frame having a plurality of ground pin holes extending therethrough receiving corresponding ground pins, the conductive frame having windows extending therethrough receiving corresponding plugs of the dielectric frame, the plugs having corresponding signal pin holes extending therethrough receiving corresponding signal pins, the plugs electrically isolating the signal pins from the conductive frame;

wherein the pin organizer substantially fills a space between the bottoms of the contact modules and the circuit board to provide electrical shielding for the signal pins between the bottom of the contact module and the circuit board.

2. The connector assembly of claim 1, wherein the dielectric frame is embedded in the conductive frame.

3. The connector assembly of claim 1, wherein the conductive frame surrounds each plug.

4. The connector assembly of claim 1, wherein the conductive frame includes a top facing the contact module and a bottom facing the circuit board, the conductive frame including channels in the bottom between the windows, the plugs being connected by tie bars received in corresponding channels.

5. The connector assembly of claim 1, wherein the windows of the conductive frame are arranged in rows and columns, the plugs being connected by tie bars, the plugs and tie bars of the dielectric frame filling the windows in a corresponding column.

6. The connector assembly of claim 5, wherein the dielectric frame is a first dielectric frame, the pin organizer further comprising a second dielectric frame separate and discrete from the first dielectric frame, the first dielectric frame filling the windows in a first column of the windows, the second dielectric frame filling the windows in a second column of the windows.

7. The connector assembly of claim 5, wherein the dielectric frame includes plugs in the rows and columns connected by the tie bars, the plugs of the dielectric frame filling each of the windows in the rows and the columns of windows in the conductive frame.

8. The connector assembly of claim 1, wherein the conductive frame includes pads connected by longitudinal cross beams and lateral cross beams, the plugs, longitudinal cross beams and lateral cross beams surrounding the windows.

9. The connector assembly of claim 1, wherein the ground pin holes are open to the windows such that the plugs extend along a side of the ground pin holes.

10. The connector assembly of claim 1, wherein the plugs have locating surfaces engaging the conductive frame to locate the dielectric frame in the conductive frame.

11. The connector assembly of claim 1, wherein the shield structure includes at least one ground shield, the ground pins extending from a bottom of the corresponding at least one ground shield, each at least one ground shield includes shield channels at the bottom thereof receiving portions of the conductive frame.

12. The connector assembly of claim 1, wherein the pin organizer engages the ground pins to electrically common the ground pins to the pin organizer and hold relative positions of the ground pins.

13. The connector assembly of claim 1, wherein the signal contacts are arranged in pairs, each plug having a pair of signal pin holes receiving a corresponding pair of the signal pins, the conductive frame separating the pairs of signal pins from each other.

14. The connector assembly of claim 1, wherein the conductive frame includes a top facing the bottom of the contact module and a bottom facing the circuit board, the top engaging the bottom of the contact modules to locate the pin organizer relative to the contact module, the top being electrically connected to the shield structure, the bottom being configured to be electrically connected to the circuit board.

15. The connector assembly of claim 1, further comprising a plurality of the contact modules arranged in a stacked configuration and received in a housing, each contact module including a ground shield defining a portion of the shield structure.

16. A connector assembly comprising:

a housing;

contact modules coupled to the housing, each contact module comprising:

a conductive holder holding a frame assembly, the frame assembly comprising a plurality of signal contacts and a dielectric frame supporting the signal contacts, the dielectric frame being received in the conductive holder, the signal contacts each including a signal pin for terminating to a circuit board, the signal pins extending from a bottom of the contact module; and a ground shield coupled to the conductive holder, the ground shield being electrically connected to the conductive holder, the ground shield having ground pins extending beyond the bottom of the contact module for terminating to the circuit board; and a pin organizer coupled to the contact modules, the pin organizer comprising a conductive frame and a dielectric frame coupled to the conductive frame, the dielectric frame having a plurality of plugs, the conductive frame having a plurality of ground pin holes extending therethrough receiving corresponding ground pins, the conductive frame having windows extending therethrough receiving corresponding plugs of the dielectric frame, the plugs having corresponding signal pin holes extending therethrough receiving corresponding signal pins, the plugs electrically isolating the signal pins from the conductive frame;

wherein the pin organizer substantially fills a space between the bottoms of the contact modules and the circuit board to provide electrical shielding for the signal pins between the bottoms of the contact modules and the circuit board.

17. The connector assembly of claim 16, wherein the dielectric frame is embedded in the conductive frame and the conductive frame surrounds each plug.

18. The connector assembly of claim 16, wherein the conductive frame includes a top facing the contact modules and a bottom facing the circuit board, the conductive frame including channels in the bottom between the windows, the plugs being connected by tie bars received in corresponding channels.

19. The connector assembly of claim 16, wherein the conductive frame includes pads connected by longitudinal cross beams and lateral cross beams, the plugs, longitudinal cross beams and lateral cross beams surrounding the plugs in the windows.

20. A pin organizer for a connector assembly having a plurality of signal pins and a plurality of ground pins extending from a bottom of the connector assembly, the pin organizer comprising:

a conductive frame having conductive pads joined by longitudinal cross beams and lateral cross beams, the conductive frame having windows extending therethrough between conductive pads, the conductive frame having ground pin holes extending therethrough configured to receive corresponding ground pins; and a dielectric frame coupled to the conductive frame, the dielectric frame having a plurality of plugs connected by tie bars, the plugs having signal pin holes extending therethrough receiving corresponding signal pins, the plugs being received in corresponding windows such that the plugs electrically isolate the signal pins from the conductive frame;

wherein each plug is surrounded by the conductive frame such that the pads of the conductive frame provide electrical shielding circumferentially around the signal pins.

* * * * *